United States Patent [19]

Welch

[11] 3,994,625

[45] Nov. 30, 1976

[54] SPUTTER-ION PUMP HAVING IMPROVED COOLING AND IMPROVED MAGNETIC CIRCUITRY

[75] Inventor: Kimo M. Welch, Mountain View, Calif.

[73] Assignee: Varian Associates, Palo Alto, Calif.

[22] Filed: Feb. 18, 1975

[21] Appl. No.: 550,393

[52] U.S. Cl. ..... 417/49; 313/179

[51] Int. Cl.[2] ..... F04B 37/02

[58] Field of Search ..... 417/48, 49, 51; 313/178–181; 315/108

[56] References Cited

UNITED STATES PATENTS

| | | | |
|---|---|---|---|
| 2,169,879 | 8/1939 | McArthur et al. | 313/180 X |
| 3,159,333 | 12/1964 | Helmer | 417/49 |
| 3,176,906 | 4/1965 | Redhead | 417/49 |
| 3,236,442 | 2/1966 | Davis et al. | 417/49 |
| 3,331,975 | 7/1967 | Jepsen | 417/49 X |
| 3,379,365 | 4/1968 | Hait | 315/108 X |
| 3,540,812 | 11/1970 | Henderson et al. | 417/49 |

FOREIGN PATENTS OR APPLICATIONS

| | | | |
|---|---|---|---|
| 1,225,608 | 3/1971 | United Kingdom | 417/49 |

*Primary Examiner*—William L. Freeh
*Assistant Examiner*—Edward Look
*Attorney, Agent, or Firm*—Stanley Z. Cole; Leon F. Herbert

[57] ABSTRACT

In a magnetically confined sputter-ion vacuum pump a multi-apertured anode electrode is interposed between a pair of reactive cathode electrode plates. An evacuable envelope encloses the anode and cathode electrodes and a magnetic circuit surrounds the vacuum envelope for producing a glow discharge confining magnetic field extending axially of the apertures in the anode. The reactive cathode plates include peripheral sealing flanges for compressing a sealing gasket into sealing engagement with a pair of sealing surfaces at opposite ends of a tubular main body portion of the envelope. A clamping ring structure, having a bolt circle formed therein, serves to clamp the two reactive cathode plates to the main body and also serves as an integral part of the magnetic circuit. Water coolant channels are brazed to the outer surfaces of the cathode plates for cooling same in use. The magnetic circuit includes a pair of ferrite magnets disposed outside the envelope on opposite sides of the cathodes and enclosed by a magnetic yoke to minimize the size and weight of the magnet and to reduce unwanted stray magnetic fields.

15 Claims, 5 Drawing Figures

FIG.3
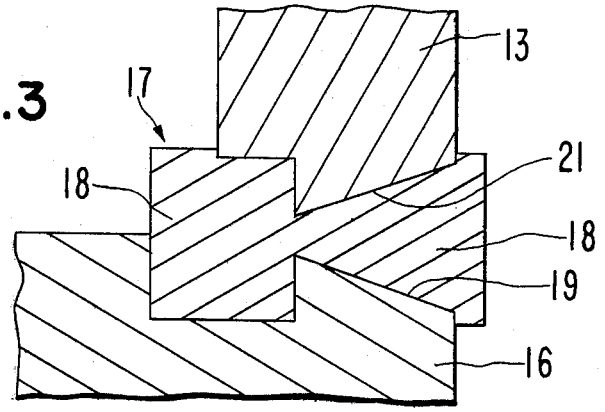
FIG.4
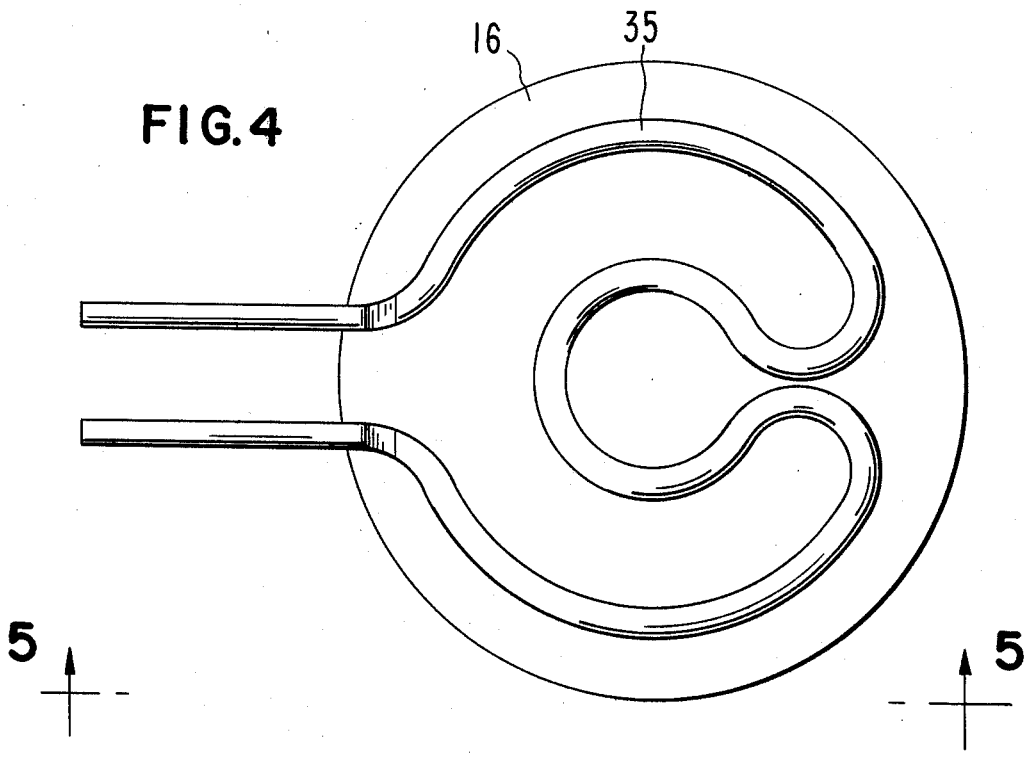
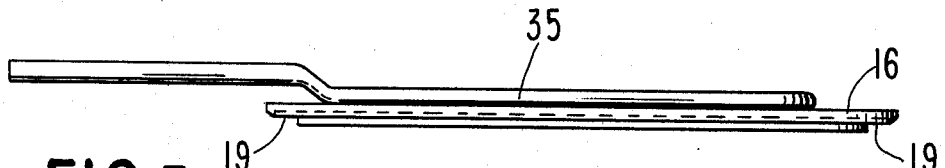
FIG.5

SPUTTER-ION PUMP HAVING IMPROVED COOLING AND IMPROVED MAGNETIC CIRCUITRY

BACKGROUND OF THE INVENTION

The present invention relates in general to sputter ion vacuum pumps and more particularly to such pumps which have high throughput and which are characterized by ease of manufacture and ease of repair and cleaning.

DESCRIPTION OF THE PRIOR ART

Heretofore, sputter-ion vacuum pumps have been proposed wherein the vacuum envelope containing the anode and cathode electrodes has been surrounded by a magnetic structure including a pair of ferrite magnets disposed on opposite sides of the envelope and cathode plates. The magnets were enclosed in a ferromagnetic yoke, whereby efficient use of the magnetic field was obtained and whereby stray magnetic fields were avoided in use. Such a prior art pump and magnetic circuit is disclosed and claimed in U.S. Pat. No. 3,159,333 issued Dec. 1, 1964.

It is also known from the prior art to braze a titanium cooling tube to the backside of a titanium reactive cathode of a sputter ion pump for cooling of the cathode in use to increase the throughput of the pump, particularly for hydrogen. Such a vacuum pump is disclosed and claimed in U.S. Pat. No. 3,331,975 issued July 18, 1967. In this prior art high throughput pump, the coolant tubes were brazed to the cathode and disposed inside the vacuum envelope of the pump. Therefore, gas tight seals had to be made in the vacuum envelope of the pump for feeding the coolant tubulation therethrough.

It is desirable to provide a high throughput sputter-ion vacuum pump which employs an efficient magnetic circuit so as to reduce the size and weight of the magnetic circuit. In addition it is desirable to provide cooling of the reactive cathode plates in such a manner that the cooling tubes are disposed externally of the vacuum envelope thereby simplifying fabrication of the cooling circuit. Furthermore, it is desired to provide an improved arrangement for replacing and cleaning the anode and cathode electrodes such that this work can be accomplished by means of simple hand tools.

SUMMARY OF THE PRESENT INVENTION

The principal object of the present invention is the provision of an improved sputter-ion vacuum pump.

In one feature of the present invention, a reactive cathode plate forms a portion of the vacuum envelope of the pump and is sealed to the remaining portion of the envelope by means of a gasket seal, whereby the cathode plate may be removed and replaced merely by use of simple hand tools.

In another feature of the present invention, gasket seals are provided at opposite ends of a tubular main body portion of the vacuum envelope for sealing a pair of end closing reactive cathode walls across opposite ends of the tubular envelope body and wherein a clamp structure surrounds the envelope for clamping the cathode end walls into sealing engagement with the tubular main body portion of the pump.

In another feature of the present invention, the reactive cathode plates close off opposite ends of the tubular main body portion of the envelope of the pump and coolant tubes are joined to the outer surfaces of the cathode end walls for cooling of the cathodes in use, whereby the coolant tubulation is disposed externally of the vacuum envelope of the pump.

In another feature of the present invention, permanent magnets are disposed on opposite sides of the vacuum envelope of the pump and a ferromagnetic yoke structure envelopes the magnets and the pumping elements, such yoke structure including a pair of clamping rings disposed at opposite ends of a ferromagnetic tubular body portion of the envelope of the pump, whereby the yoke structure includes the clamp means and the tubular body of the envelope of the pump.

Other features and advantages of the present invention will become apparent upon a perusal of the following specification taken in connection with the accompanying drawings wherein:

BRIEF DESCRIPTION OF THE DRAWINGS

FIG. 3 is an enlarged detail view of a portion of the structure of FIG. 2 delineated by line 3—3, FIG. 4 is a plan view of a portion of the structure of FIG. 2 taken along line 4—4 in the direction of the arrows, and FIG. 5 is a side view of the structure of FIG. 4 taken along line 5—5 in the direction of the arrows.

DESCRIPTION OF THE PREFERRED EMBODIMENTS

Figure 1:
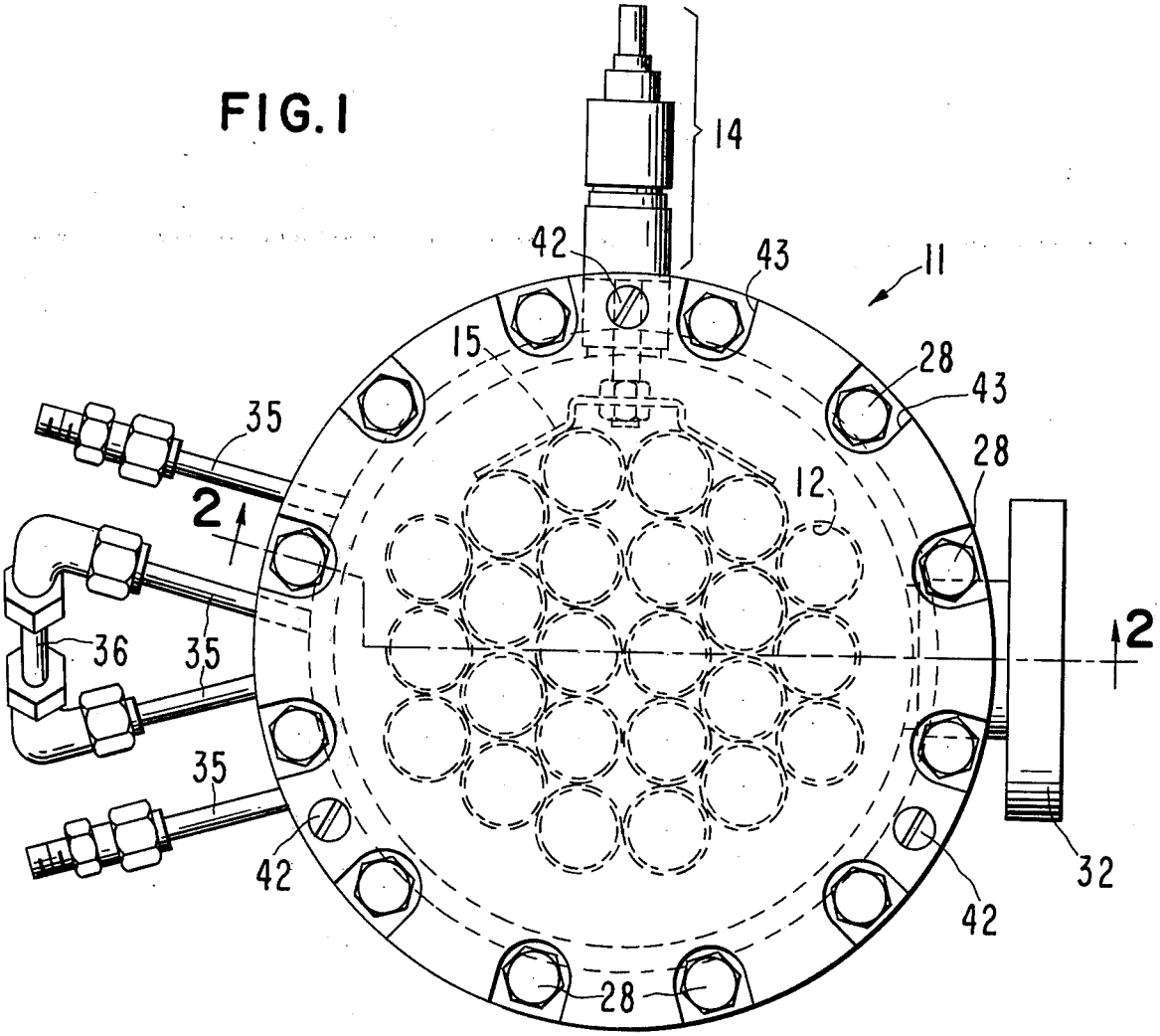
FIG. 1 is a plan view of a vacuum pump incorporating features of the present invention.
Figure 2:
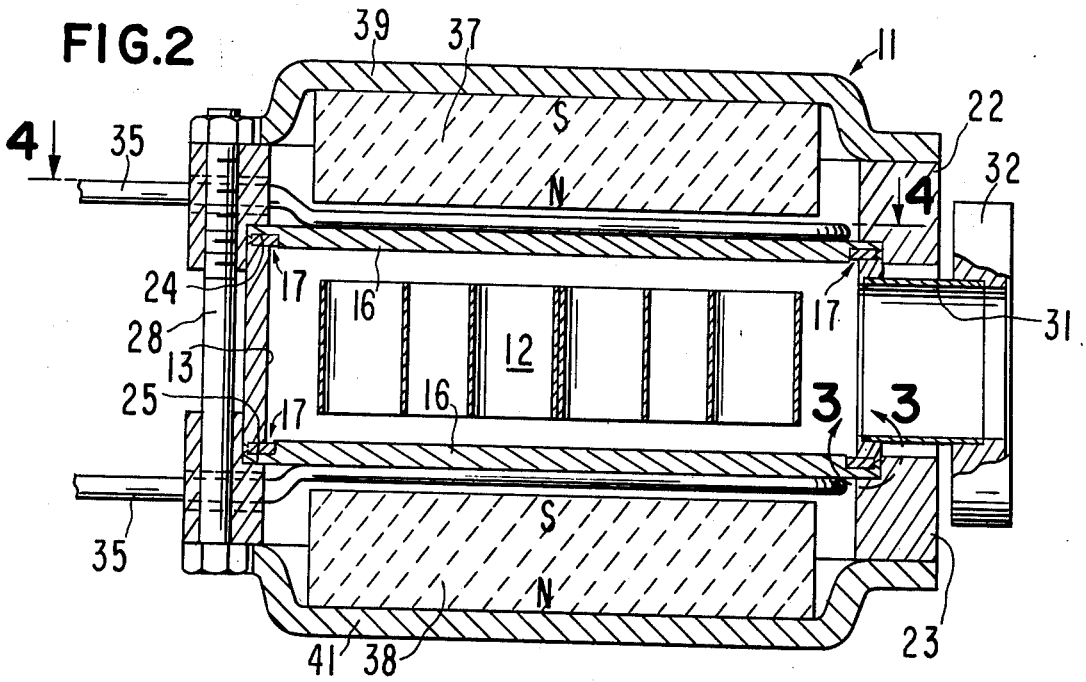
FIG. 2 is a sectional view of the structure of FIG. 1 taken along line 2—2 in the direction of the arrows.

Referring now to FIGS. 1 and 2, there is shown a sputter-ion vacuum pump 11 incorporating features of the present invention. The pump 11 includes an array of closely packed anode cylinders 12, as of stainless steel, spot welded together at points of tangency and supported within a tubular main body portion 13 of the vacuum envelope of the pump 11 by means of a high voltage feedthrough insulator assembly 14 affixed to the anode array 12 via a bracket 15.

Opposite ends of the tubular main body portion 13 of the envelope are closed off by means of circular reactive cathode plates 16, as of titanium or tantalum. The reactive cathode plates 16 are sealed in a gas-tight manner to opposite ends of the tubular main body 13 via a deformable gasket seal 17.

The gasket seal 17 is of conventional design and includes an annular soft metal gasket 18, as of copper, captured between the annularly grooved sealing surfaces 19 and 21 of the axially opposed portions of the cathode plate 16 and the main body portion 13. This type of vacuum-tight seal is disclosed and claimed in U.S. Pat. No. 3,208,758 issued Sept. 28, 1965. Other forms of vacuum sealing may be used such as soft wire gaskets and elastomer gaskets.

The end closing cathode plates 16 are clamped into sealing engagement with the intervening sealing gaskets 18 and the main body 13 via a pair of annular clamping rings 22 and 23 disposed at the outer periphery of the envelope at opposite ends thereof. The clamping rings 22 and 23 are preferably made of a ferromagnetic material, such as steel or iron, and include internal shoulders 24 and 25 for catching the outer lips of the cathode plates 16. The clamping rings 22 and 23 each include a circle of axially directed bolt holes 26 and 27 to receive a circle of bolts 28 therethrough. The bolts 28 are provided at 30° intervals about the periphery of the clamping rings 22 and 23 and when tightened down serve to compress the annular sealing gasket members 18 into sealing engagement with the opposed sealing surfaces 19 and 21 of the cathode plates 16 and the main body 13. The main body 13 includes a circular port to which an exhaust tubulation 31 is sealed as by brazing. A coupling flange 32 is affixed to the outer end of the exhaust tubulation 31 for sealing the pump 11 to structures to be evacuated.

The titanium coolant tubulation 35 (see FIGS. 4 and 5) is brazed to the outside surface of the respective cathode plates 16 in a double loop configuration so as to provide adequate cooling of the cathode plates 16 in use. After the titanium tubulation 35 has been brazed to the titanium cathode plates 16, the tubulation is flattened slightly against the cathode surface 16 so as to reduce the overall thickness of the tubulation 35. The tubulation 35 extends through radially directed bores in the clamping rings 22 and 23 and one end of the tubing of one of the cathode plates is connected to one end of the tubing of the opposed cathode plate via a generally axially directed section of tubing 36 so that the two coolant tubes 35 are connected for series coolant flow. In this manner, coolant is directed into one end of the coolant tubing 35 and flows through both double loop portions of the conduit 35 to waste or to a heat exchanger.

A pair of disc-shaped permanent magnetized ferrite magnets 37 and 38 of opposite polarity are disposed on opposite sides of the reactive cathode plate portions 16 of the vacuum envelope of the pump 11. The magnets 37 and 38 are affixed by their own magnetic attractions to the inside surfaces of a pair of opposed cup-shaped end hats 39 and 41, respectively, as of steel or iron. The end hats 39 and 41 are affixed to the clamping rings 22 and 23, as by screws 42 disposed at 120° intervals about the periphery of the end hats 39 and 41, respectively. The outer peripheries of the end hats 39 and 41 are castellated at 43 to accommodate the circles of bolts 28. The ferromagnetic end hats 39, 41, ferromagnetic clamps 22 and 23, and the ferromagnetic tubular body 13 taken together form a soft iron magnetic yoke structure enclosing the magnets 37 and 38, whereby an efficient use of the available magnetomotive force of the magnets 37 and 38 is obtained. The yoke structure further serves to reduce stray magnetic fields which would otherwise leak from the magnetic circuit.

While the preferred embodiment employs a magnetic tubular main body portion 13 of the vacuum envelope for the pump this is not a requirement as the clamping rings 22 and 23 may be extended axially of the tubular envelope 13 so that the clamping rings abut or nearly abut each other at their inner ends. In this case, the tubular main body 13 may be made of a nonferromagnetic material as it is not needed to form a portion of the yoke of the magnetic circuit.

In operation, an anode potential of several KV positive is applied to the anode 12 via feedthrough 14 relative to the cathode plates 16 to establish a glow discharge in the partially evacuated interior of the pump 11. The glow discharge extends through the glow discharge passageways defined by the hollow interiors of the anode cylinders 12. The glow discharge is enhanced and magnetically confined by the axial magnetic field. Positive ions created in the glow discharge are driven into the cathode plates for sputtering therefrom reactive cathode material for gettering gas and for burial of gas.

The advantages of the pump 11 of the present invention include the ability to replace the cathode plates 16 merely by loosening the bolts 28 and removing the clamping rings 22 and 23 and the end cathode plates 16. After replacement of the gasket material 18 the cathode plates 16 may be replaced and the bolts 28 tightened. Once the cathode plates 16 are removed, the anode 12 may be cleaned as by sand-blasting. The pump may be baked by with or without removing the magnets 37 and 38 together with their accompanying end hats 39 and 41. In short, the vacuum pump 11 may be cleaned and repaired merely by the use of simple hand tools and readily replaceable gaskets 18.

What is claimed is:

1. In a magnetically confined sputter-ion vacuum pump:

anode electrode means having an aperture therein for defining a glow discharge passageway;

cathode electrode surfaces opposite said glow discharge passageway of said anode electrode means;

evacuable envelope means for connection in gas communication with a structure to be evacuated and for enveloping said anode electrode means and said cathode surfaces to permit subatmospheric pressure to be developed in the region of space between said anode means and said cathode surfaces and within said glow discharge passageway;

magnet means positioned externally of said envelope means for producing and directing a magnetic field through said glow discharge passageway of said anode electrode means;

magnetic enclosure means around said magnet means and forming a magnetic field circuit connection to said envelope means; and said envelope means having a magnetic portion forming with said enclosure means a substantially continuous magnetic circuit around said magnet means.

2. A sputter-ion vacuum pump comprising:

an envelope having a side wall portion, and two end wall portions joined respectively to the opposite ends of said side wall portion to form evacuable envelope means for connection in gas communication with a structure to be evacuated;

anode electrode means inside said envelope and having an aperture defining a glow discharge passageway facing said end wall portions;

cathode electrode surfaces inside said envelope facing said glow discharge passageway;

said side wall portion being a magnetic material; and said end wall portions being a non-magnetic material.

3. A sputter-ion pump as claimed in claim 2 further comprising magnet means positioned outside said envelope adjacent said end wall portions and magnetically connected to said side wall portion.

4. A sputter-ion pump as claimed in claim 2 wherein the joints between said side and end wall portions comprise demountable compression joints, and clamping means of magnetic material providing the compression for said joints, whereby magnets can be located outside said envelope adjacent said end wall portions and magnetically connected to said side wall portion through said clamping means.

5. A sputter-ion vacuum pump comprising:

an envelope having a tubular side wall portion and two end wall portions respectively closing opposite ends of said tubular portion;

compression sealing means between said tubular portion and each of said end wall portions;

a tubular clamping member outside each end of said envelope and respectively abutting the outer face of its adjacent end wall portion, and means for compressing said clamping members toward each other;

a magnet positioned adjacent the outside face of each of said end wall portions and magnetically coupled to the adjacent one of said tubular clamping members;

anode electrode means inside said envelope and having an aperture defining a glow discharge passageway facing said end wall portions;

cathode electrode surfaces inside said envelope facing said glow discharge passageway; and said end wall portions being of non-magnetic material and said tubular clamping members being of magnetic material whereby a magnetic field is formed internally of said envelope through said discharge passageway and at least a portion of the return magnetic path is through said clamping members.

6. A sputter-ion pump as claimed in claim 5 wherein said end wall portions comprise active metal inner surfaces forming said cathode electrode surfaces.

7. A sputter-ion pump as claimed in claim 6 in which said end wall portions are active metal throughout their thickness, and further comprising fluid conduit means coupled in heat exchanging relation to the outside of said end wall portions.

8. A sputter-ion pump as claimed in claim 7 in which said fluid conduit means pass through apertures in said tubular clamping members.

9. A sputter-ion pump as claimed in claim 5 in which said tubular side wall portion is magnetic material.

10. A sputter-ion pump as claimed in claim 5 in which said magnetic coupling between said magnets and said tubular clamping members comprises end pieces of magnetic material across the outer faces of said magnets and abutting said tubular clamping members.

11. A sputter-ion pump as claimed in claim 10 wherein attachment means are provided for connecting said end pieces to said tubular clamping means and said attachment means are separate from said means for compressing said clamping members toward each other, whereby said end pieces and magnets can be removed without removing said end wall portions.

12. A sputter-ion pump as claimed in claim 5 wherein said tubular clamping members extend one toward the other so as to surround at least a portion of the length of said side wall portion.

13. A sputter-ion vacuum pump comprising:

an envelope having a side wall portion and two end walls respectively closing opposite ends of said side wall portion;

anode electrode means inside said envelope and having an aperture defining a glow discharge passageway facing said end wall, said anode electrode means being electrically insulated from said end walls;

said end walls each being of active metal material throughout its thickness and each forming a cathode electrode, and said side wall portion being of a material different from either of said end walls;

said end walls each having a sealing surface facing the adjacent end of said side wall portion;

said sealing surfaces and the adjacent ends of said side wall portion being configured to form a compression seal between them;

and clamping means for forcing each of said sealing surfaces toward the adjacent ends of said side wall portion.

14. A sputter-ion vacuum pump as claimed in claim 13 further comprising fluid cooling tubulation bonded to the outside of each of said end walls, said tubulation being of the same material as the end wall to which it is bonded.

15. A sputter-ion vacuum pump as claimed in claim 13 further comprising magnet means positioned adjacent the outer face of each of said end walls to provide a magnetic field inside said envelope between said end walls.

* * * * *